US011794361B2

(12) United States Patent
Glockseisen et al.

(10) Patent No.: US 11,794,361 B2
(45) Date of Patent: Oct. 24, 2023

(54) GROUP OF MANUAL PLIERS

(71) Applicant: WEZAG GmbH Werkzeugfabrik, Stadtallendorf (DE)

(72) Inventors: Thomas Glockseisen, Duesseldorf (DE); Kurt Battenfeld, Wittelsberg (DE)

(73) Assignee: WEZAG GMBH & CO. KG, Stadtallendorf (DE)

( * ) Notice: Subject to any disclaimer, the term of this patent is extended or adjusted under 35 U.S.C. 154(b) by 54 days.

(21) Appl. No.: 16/884,656

(22) Filed: May 27, 2020

(65) Prior Publication Data

US 2020/0376693 A1 Dec. 3, 2020

Related U.S. Application Data

(62) Division of application No. 15/299,697, filed on Oct. 21, 2016, now abandoned.

(30) Foreign Application Priority Data

Oct. 23, 2015 (EP) ..... 15191261

(51) Int. Cl.
*B26B 13/26* (2006.01)
*B26D 3/16* (2006.01)

(52) U.S. Cl.
CPC ..... *B26B 13/26* (2013.01); *B26D 3/169* (2013.01)

(58) Field of Classification Search
CPC ..... B26B 13/26; H02G 1/005; B25B 7/12; B25B 7/22; B26D 3/169; B23D 21/06; B23D 21/08
USPC ..... 30/92, 98, 99, 251, 253
See application file for complete search history.

(56) References Cited

U.S. PATENT DOCUMENTS 476,459 A * 6/1892 Hamann et al. ..... B26B 13/26 30/252
1,455,297 A 5/1923 Lyons et al.
4,062,218 A * 12/1977 Wiener ..... H02G 1/005 81/319
4,176,450 A * 12/1979 Muromoto ..... B26D 3/169 30/92
4,186,484 A * 2/1980 Tanaka ..... B23D 29/023 30/251
4,368,577 A * 1/1983 Babb ..... B26D 3/169 30/92
4,378,636 A * 4/1983 Wick ..... H02G 1/005 30/92
4,644,650 A * 2/1987 Laux ..... H02G 1/005 30/92

(Continued)

FOREIGN PATENT DOCUMENTS

CN 204321888 U 5/2015
DE 1060808 B 7/1959

(Continued)

*Primary Examiner* — Jason Daniel Prone
(74) *Attorney, Agent, or Firm* — Thomas | Horstemeyer, LLP

(57) ABSTRACT

Manual pliers of different types and/or geometries are described. The manual pliers have a modular design. Here, without any adaptations of the design, a base module can be combined with different pliers head modules. The modular design makes it possible to reduce the manufacturing costs and to use a large number of same parts for manufacturing manual pliers of different types.

6 Claims, 11 Drawing Sheets

(56) References Cited

U.S. PATENT DOCUMENTS

| | | | | |
|---|---|---|---|---|
| 5,129,158 | A * | 7/1992 | Campagna | B26D 3/169 30/92 |
| 5,184,404 | A | 2/1993 | Chen | |
| 5,218,768 | A | 6/1993 | Putsch et al. | |
| 5,526,570 | A | 6/1996 | Beetz et al. | |
| 5,718,051 | A * | 2/1998 | Huang | B26D 3/169 30/92 |
| 6,098,291 | A * | 8/2000 | Wang | B23D 21/06 30/92 |
| 6,154,966 | A * | 12/2000 | Kobayashi | H02G 1/005 30/250 |
| 6,178,643 | B1 * | 1/2001 | Erbrick | B26B 15/00 30/92 |
| 6,282,995 | B1 | 9/2001 | Lin | |
| 6,467,172 | B1 * | 10/2002 | Jenq | B26D 3/169 30/92 |
| 6,481,105 | B1 * | 11/2002 | Haung | B23D 21/06 30/99 |
| 6,612,147 | B2 | 9/2003 | Beetz et al. | |
| 6,647,835 | B1 | 11/2003 | Tseng | |
| 6,707,007 | B1 | 3/2004 | Siddoway | |
| 6,786,117 | B1 | 9/2004 | Tseng | |
| 7,637,017 | B2 | 12/2009 | Retterer et al. | |
| 7,735,399 | B2 | 6/2010 | Robinson et al. | |
| 7,743,509 | B2 * | 6/2010 | Macsay | B23D 21/06 30/92 |
| 9,987,760 | B2 | 6/2018 | Zinser | |
| 10,232,452 | B2 * | 3/2019 | Chen | B23D 21/06 |
| 2004/0134073 | A1 * | 7/2004 | Kochi | B26D 7/1863 30/92 |
| 2013/0152404 | A1 | 6/2013 | Huang | |
| 2016/0111840 | A1 * | 4/2016 | Battenfeld | H01R 43/042 72/409.14 |
| 2017/0113358 | A1 * | 4/2017 | Glockseisen | B26D 3/169 |

FOREIGN PATENT DOCUMENTS

| | | | |
|---|---|---|---|
| DE | 9104138 | U1 | 6/1991 |
| DE | 9010931 | U1 | 11/1991 |
| DE | 4206535 | A1 | 9/1993 |
| DE | 4303180 | C1 | 1/1994 |
| DE | 4334361 | A1 | 4/1995 |
| DE | 91 17 126 | | 5/1996 |
| DE | 19940408 | A1 | 3/2000 |
| DE | 10 2004 062 521 | | 7/2006 |
| DE | 10201210758 | | 5/2015 |
| EP | 2357052 | A1 | 8/2011 |

* cited by examiner

GROUP OF MANUAL PLIERS

CROSS REFERENCE TO RELATED APPLICATIONS

This is a divisional application which claims priority to U.S. patent application Ser. No. 15/299,697, filed Oct. 21, 2016, which application claims priority to European patent application No. EP 15 191 261.5 filed Oct. 23, 2015.

FIELD OF THE INVENTION

The invention relates to a group of different manual pliers. The different manual pliers might differ with respect to the type of processing of a workpiece, the geometry of the processed workpiece, the geometry of the manual pliers and the like. Preferably, the manual pliers are cutting pliers which can be used for cutting workpieces as e.g. cables. In this case the different manual pliers are e.g. designated for different diameters and/or hardnesses of the cable which is to be cut. It is also possible that the different manual pliers comprise different cutting jaws (in particular on the one hand scissor-like open cutting jaws and on the other hand cutting jaws being closed in circumferential direction).

The publication US 2013/0152404 A1 discloses scissors that might be embodied as loppers or manual scissors. The scissors comprise a fixed blade and a movable blade. The movable blade is supported by a swivel bolt in a pivot joint which is located at the fixed blade. The movable blade is actuated by an actuation lever. The actuation lever is supported by a swivel bolt in a pivot joint which is located remote from the pivot joint for the movable blade located at the fixed blade. In one end region the swivel bolts for forming the pivot joint for the movable blade and the actuation lever are held by the fixed blade. In the other end region the swivel bolts are held by a connecting link. An arm extending from the movable blade comprises an angled end region which comprises an inner toothing being curved corresponding to the distance from the pivot joint of the movable blade. This inner toothing meshes with an outer toothing formed by a bending of the actuation lever. The outer toothing is curved corresponding to the distance of the outer toothing from the pivot joint of the actuation lever. Both the arm with the bending as well as the actuation lever with the bending and the formed toothings are formed by a metal sheet. In order to avoid that for the considerable forces acting upon the blades and the actuation lever and the arm due to deformations of the metal sheets the toothings disengage (so that it is no longer possible to drive the blades), the actuation lever and the bending of the arm are coupled to each other by a connecting link. The connecting link is coupled by an elongate hole to the bending of the arm in a way such that the connecting link only comes into effect at the end of the closing stroke of the blades.

U.S. Pat. No. 6,786,117 B1 discloses pliers with two scissor-like pliers bodies being pivoted about a pivot joint. The pliers bodies each form a hand lever and pliers jaws. Here, the pliers jaws are each removably mounted to the associated hand levers. If a couple of pliers jaws of a first type are mounted to the hand levers, at the same time another couple of pliers jaws of a different type is stored between cover plates of the hand levers. It is possible to exchange the pliers jaws of the first type with pliers jaws of the second type. In this way a multifunctional use of the pliers is intended.

Prior art related to ratchet cutters or cable cutters is known from the publications EP 2 357 052 A1 and DE 10 2012 101 758 A1.

SUMMARY OF THE INVENTION

The invention relates to a group of manual pliers. The group of manual pliers comprises a first group part with manual pliers (e.g. manual pliers of a type A) as well as a second group part with manual pliers (e.g. manual pliers of a type B). The manual pliers of the first group part and of the second group part (accordingly for the given example the manual pliers of types A and B) are designated and designed for processing different workpieces.

According to the invention, a modular design of the manual pliers of the two group parts is proposed. Here, manual pliers can be formed with two, three or more modules. The single modules of the manual pliers can be manufactured with a large number of parts at reduced costs. A specification of the manual pliers for the group parts (so for the given example for the formation of Type A or B) can then be provided by a combination of different modules.

According to the invention, the manual pliers of the different group parts comprise at least transmission modules having identical designs which increases the number of the same parts. Here, the identical design of the transmission module covers the identical design of single components of the transmission module, the provision of identical interfaces of the transmission module to the other modules, the same dimensions of the transmission module and the same locations and designs of holding devices of the transmission module (e.g. locations and diameters of bores of a housing plate of the transmission module for the accommodation of a holding bolt, a swivel bolt, distance holders and the like).

For a particular embodiment of the invention the transmission modules of the manual pliers of the two group parts which have identical designs comprise identical interfaces for connecting the transmission module to different pliers head modules (for the given example a pliers head module type A and a pliers head module type B). Here, the different pliers head modules have counter-interfaces with designs identical to the interfaces of the transmission modules and serve for the formation of manual pliers of the first group part (manual pliers of type A) on the one hand and for the provision of manual pliers of the second group part (type B) on the other hand. By the use of standardized or unitized interfaces of the transmission modules it is possible to manufacture the transmission module in a standardized or unitized manufacturing process independent on the type of pliers head module to which at a later point in time the transmission module will be assembled.

For an alternative or cumulative embodiment the transmission modules might have identical interfaces for the connection of the transmission module to counter-interfaces of different hand lever modules so that it is possible to form the manual pliers of the different group parts. Accordingly, an individualization of the manual pliers can be accomplished by using the same transmission modules together with different hand lever modules.

Generally, the transmission modules might have any design. For one proposal of the invention, the transmission modules each comprise a housing plate. Swivel bolts are held by the housing plate. By the swivel bolts further components of the manual pliers (in particular components of the transmission module) are supported by the housing plate for being pivoted. For an alternative or cumulative embodiment it is possible that transmission elements of the transmission module which are moved during the actuation of the manual pliers (e.g. a movable hand lever part, a pushing lever and/or a latching lever) can be directly or indirectly born by or linked to the housing plate. For some embodiments all of the components of the transmission module are held or born by the housing plate. For some embodiments the components of the transmission module as far as possible or all of them extend on one side of the housing plate. It is possible that swivel bolts, supporting bolts, distance holders and the like are born in one end region of the same in the housing plate or held by the same. For a particular embodiment of the invention, in the other end region these components are additionally held by a housing plate of the pliers head module or born by the same.

For a further embodiment of this solution the transmission module comprises an opening. For the disassembled pliers head module, through the opening swivel bolts (used for supporting movable transmission elements of the transmission module and/or transmission elements of the transmission modules being moved during the actuation of the manual pliers) are accessible. In an extreme case it is possible that for disassembled pliers head module the swivel bolts and the transmission elements are only covered on one side given by the housing plate of the transmission module. With the exception of this cover the swivel bolts and the transmission elements are freely accessible so that the opening is formed in any region where the housing plate does not extend. With the assembly of the pliers head module the opening is at least partially closed by a housing plate of the pliers head module in the direction transverse to the pliers head plane. It is e.g. possible that in this partially closed state of the opening the swivel bolts and the transmission elements of the transmission module extend between the housing plate of the transmission module and the housing plate of the pliers head module.

For another inventive group of manual pliers at least one transmission element which is moved during the actuation of the hand levers and/or a movable hand lever are/is supported both by the housing plate of the pliers head module as well as by the housing plate of the transmission module for being rotated. In order to mention only one example, it is possible that the support for being rotated is provided by a swivel bolt supporting the transmission element or the movable hand lever and housed or accommodated with its end regions in the two afore mentioned housing plates. Accordingly, the housing plates comprise aligned bores. The connection between a swivel bolt and a bore of the housing plate can be provided by pressing, fixing into place or calking, by a rotatable bearing, e.g. by use of a journal bearing or slide bearing, by a locking or snapping ring arranged at the outer side of the housing plate and the like.

It is generally possible that the housing plates of the transmission module are formed separately from a fixed hand lever or a hand lever plate of a fixed hand lever. In this case the hand lever or the hand lever plate is not a component of the transmission module but instead of another module or forms a component of another module which can be assembled to the transmission module. However, for one inventive embodiment the housing plates of the transmission module are integrally formed as one piece by a hand lever or a hand lever plate. In this way it is possible to simplify the manufacturing process and to avoid a join patch or assembly interface between the housing plate and the hand lever plate.

It is generally possible that the housing plate on the one hand and the hand lever plate on the other hand have a planar design. However, in a preferred embodiment of the invention the housing plate continuous via an offset or crank to the hand lever or hand lever plate. Here, preferably the offset or crank is approximately the half (in particular ±20% or ±10% or ±5 of the half) of the distance of the housing plates of the transmission module and the pliers head module in the assembled state. When choosing these dimensions of the offset or crank, the offset or crank can be used for a compensation. This compensation provides that the housing plates delimit the pliers head in the region of the transmission in a direction transverse to the pliers head plane. At the same time due to the offset or crank it is possible to arrange the hand lever plate in a middle pliers head plane which is arranged approximately in the middle between the two housing plates and which extends approximately in the middle through one of the handles.

Any manufacturing process for the single components of the manual pliers can be used. So, it is e.g. possible to manufacture a base body forming the fixed cutting jaw and a housing plate of the pliers head module in a fine injection molding process. For a particular proposal of the invention, at least one hand lever and/or the housing plate of the transmission module are/is manufactured by punching of a metal sheet which leads to a further reduction of the manufacturing costs.

For the types of manual pliers in the single group parts there are also a lot of options. For a particular inventive solution the manual pliers of the first group part comprise a pliers head module with scissor-like open cutting jaws, whereas manual pliers of the second group part comprise a pliers head module with cutting jaws being closed in circumferential direction.

For the design of the kinematics of the transmission interposed between the hand levers on the one hand and the cutting jaws on the other hand there are a lot of options with any type of transmitting connections and pivoting directions of the related components resulting thereof. For one inventive proposal, in the manual pliers the pivoting direction of a movable hand lever has an orientation opposite to the pivoting direction of an associated movable cutting jaw. Accordingly, it is e.g. possible that the movable hand lever is pivoted in clockwise direction with the closure, whereas the associated movable cutting jaw is pivoted opposite to the clockwise direction.

Also with respect to the location of the joint for the pushing lever there are a lot of different options. For one of the options, the pivot joint for bearing the pushing lever is located at the movable hand lever. In this case the movable hand lever is supported for being pivoted by a housing plate of the transmission module at a location between the pivot joint and a handle of the hand lever.

For a particular proposal of the invention the pliers head modules are each built with an integral base body forming both a housing plate and a fixed cutting jaw. The base body is e.g. manufactured by use of an injection molding process. The transmission module comprises a housing plate which can in particular be manufactured by punching of a metal sheet and/or be formed integrally with the hand lever plate. After the assembly of the pliers head module to the transmission module, at least one swivel bolt (preferably both a swivel bolt for a pivotable support of the movable hand lever and a swivel bolt for the pivotable support of the hand lever) is in one end region born by or fixed at the housing plate of the base body of the pliers head module and in the other end region born by or fixed at the housing plate of the transmission module.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to these features, or these features may be the only features of the respective product.

The reference signs contained in the claims are not limiting the extent of the matter protected by the claims. Their sole function is to make the claims easier to understand.

DETAILED DESCRIPTION

In the following, the invention is further explained and described with respect to preferred exemplary embodiments illustrated in the drawings.

FIG. 1 shows manual pliers with disassembled pliers head module in a three-dimensional view.

FIG. 2 shows a plan view of a pliers head plane of the manual pliers of FIG. 1, however with assembled pliers head module wherein a housing plate having an offset and a hand lever plate of a transmission module are not shown.

FIG. 3 shows a detail III of the manual pliers of FIG. 2 at the beginning of a working stroke.

FIG. 4 shows the manual pliers in a detail according to FIG. 3 in a partially closed position during a first part of the working stroke.

FIG. 5 shows the manual pliers in a detail corresponding to FIGS. 3 and 4 for a reopening of the hand levers after the first part of the working stroke.

FIG. 6 shows the manual pliers in a detail corresponding to FIGS. 3 to 5 for the interruption or termination of a working stroke with a release of the latching lever by a provision of a small closing movement.

FIG. 7 shows the manual pliers in a detail corresponding to FIGS. 3 to 6 for a manual pivoting of the latching lever out of engagement with a toothing of a movable cutting jaw for allowing an opening movement.

FIG. 8 shows the manual pliers in a detail corresponding to FIGS. 3 to 7 in a second maximal opening position.

FIGS. 9(*a*), 9(*b*), 9(*c*), and 9(*d*) show a modular group of manual pliers which can be built with the same base modules and different pliers head modules.

FIGS. 10(*a*), 10(*b*), 10(*c*), and 10(*d*) show a group of manual pliers which can be built with the same pliers head modules and the same transmission modules but different hand lever modules.

FIGS. 11(*a*), 11(*b*), and 11(*c*) show another embodiment wherein different manual pliers are built with the same pliers head modules and the same transmission modules but different hand lever modules.

Figure 1:
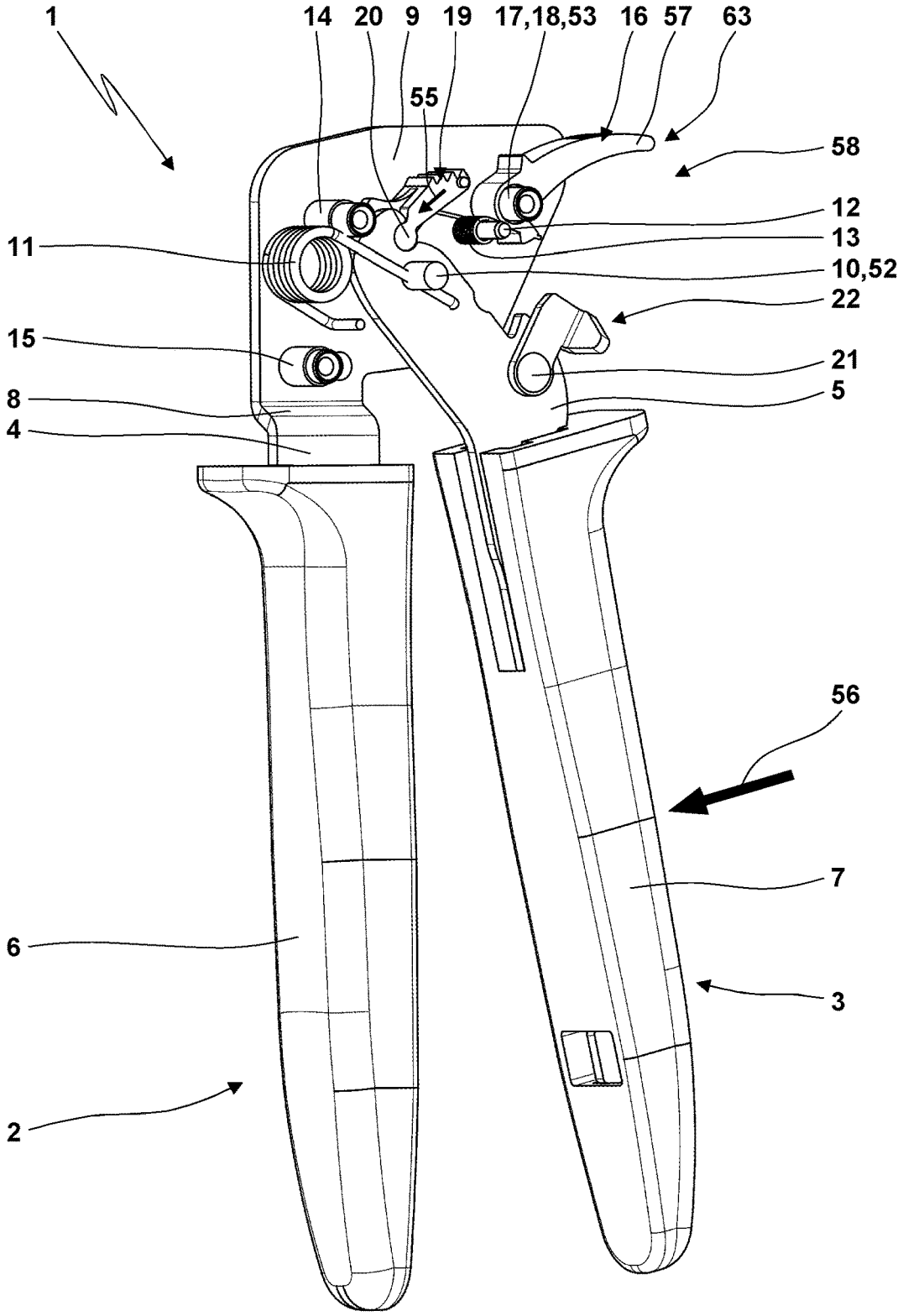
FIG. 1 shows partially disassembled manual pliers 1 with a fixed hand lever 2 and a movable hand lever 3. The hand levers 2, 3 each comprise an elongate hand lever plate 4, 5. In the region accessible for the user of the manual pliers 1 the hand lever plates 4, 5 are each covered by a preferably elastomeric handle 6, 7. The outer contour and the stiffness of the handles 6, 7 are optimized with respect to the actuating contact with the hand of the user. The hand lever plate 4,5 integrally continues via an offset or crank 8 to a housing plate 9. A pliers head plane is defined by the plane of extension of the housing plate 9. The housing plate 9 serves for pivotally supporting the movable hand lever 3 and the transmission elements of the driving transmission of the manual pliers 1 and for the provision of fixations for a pliers head module.

A swivel bolt 10 for the formation of a pivot joint 52 is held by the housing plate 9. By the swivel bolt 10 the movable hand lever 3 is pivotally supported by the housing plate 9 and so by the fixed hand lever 2. Additionally, an opening spring 11 (here a leg of a spiral spring or leg spring) is supported by the swivel bolt 10. The housing plate 9 carries a bolt 12 which extends through a biasing spring 13 (here also a spiral spring or leg spring). Furthermore, the housing plate 9 carries distance holders 14, 15 formed by stepped bolts or sleeves. A latching lever 16 is supported by a swivel bolt 17 for the provision of a pivot joint 53 for being pivoted relative to the housing plate 9. With stepped end regions protruding on both sides of the latching lever 16 the swivel bolt 17 at the same time forms another distance holder 18. By a pivot joint 20 a pushing lever 19 is pivotally mounted to the hand lever plate. The pivot joint 52 formed with the swivel bolt 10 is located between the pivot joint 20 for the support of the pushing lever 19 and the hand lever 7. For the shown embodiment, the pivot joint 20 is formed with a divided circular cutting of the hand lever plate 5 with a circumferential angle being slightly larger than 180°. An end region of the pushing lever 19 having the shape of a part of a cylinder is pressed or "clipsed" into the cutting.

By a pivot joint 21 a fixing lever 22 is linked to the hand lever 3. The pivot joint 21 is located between the handle 7 and the swivel bolt 10.

The hand lever 3, the fixing lever 22, the latching lever 16 and the pushing lever 19 can be pivoted about pivot axes being parallel to each other and having an orientation perpendicular to the pliers head plane. During a pivoting movement of this type the transmission elements or the hand lever plate 5, the latching lever 16 and the pushing lever 19 are at least partially guided by the housing plate 9. The opening spring 11 and the biasing spring 13 are biased by a torsional moment. The vector of the torsional moment also has an orientation vertical to the pliers head plane. In the partially disassembled state shown in FIG. 1 a part of the components or all of them can be held loosely by the housing plate 9 or can be held by the housing plate 9 in a loss-proof fashion.

Figure 2:
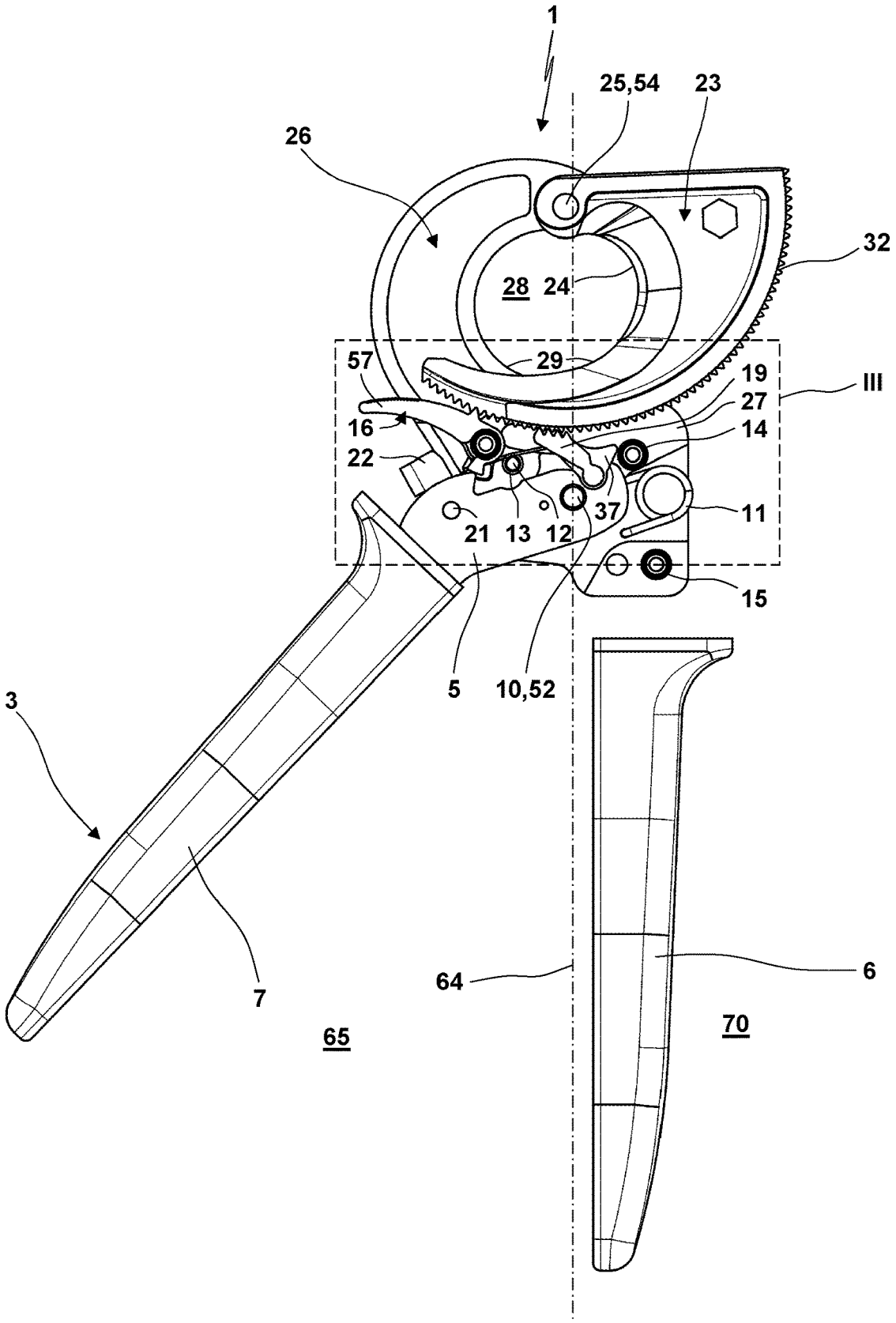

FIG. 2 shows the manual pliers 1 in another partially disassembled state. Here, the fixed hand lever 2 is only shown with its handle 6, whereas the hand lever plate 4 and the housing plate 9 are not shown. The movable cutting jaw 23 comprises an inner cutting edge 24 having (in a first rough approximation) a sickle-shape or partially spiral-shape and having an outer toothing 32 along a bow having the shape of a part of a circle. The movable cutting jaw 23 is linked by a pivot joint 25 (which is formed with a swivel bolt 54) to a fixed cutting jaw 26. The fixed cutting jaw 26 is formed integrally with a housing plate 27. Here, the housing plate 27 and the cutting jaws 23, 16 extend parallel to the pliers head plane with a pivoting movement of the movable cutting jaw 23 about a pivot axis defined by the pivot joint 25. Here, the pivot axis has an orientation perpendicular to the pliers head plane. The cutting jaws 23, 26 pass or cross each other with the smallest possible distance.

In the operational state shown in FIG. 2, the cutting jaws 23, 26 build an accommodation 28 for a workpiece which is to be cut by the manual pliers 1. The accommodation 28 is limited by the accommodation contour or cutting contour 29 formed by the cutting edge 24 of the movable cutting jaw 23 and of the fixed cutting jaw 26. The cross-sectional surface of the cutting contour 29 decreases during the working stroke of the manual pliers 1 and changes its geometry during the working stroke of the manual pliers 1.

Figure 3:
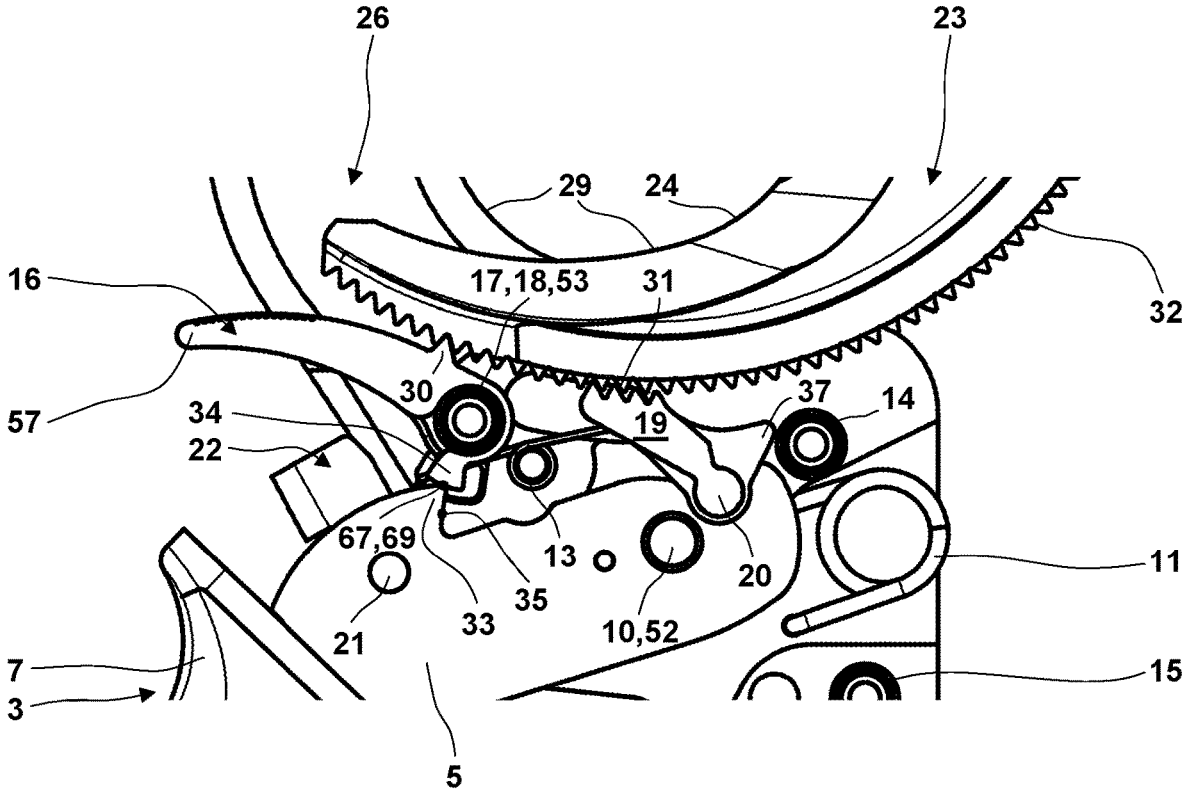
Figure 4:
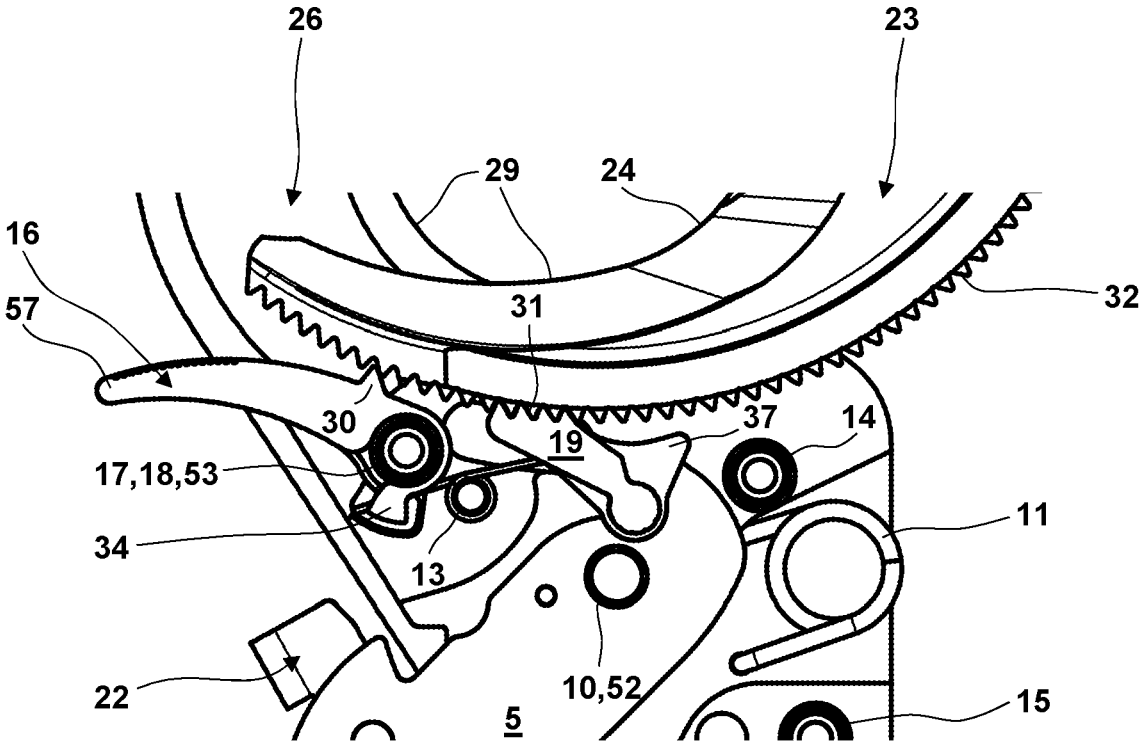

FIG. 3 shows a detail III of FIG. 2. The manual pliers 1 are in a starting state. In the starting state it is possible to insert a workpiece (in particular a cable) into the accommodation 28. The latching lever 16 comprises a latching nose 30. The latching nose is latched with the toothing 32 of the movable cutting jaw 23 for latching the pivot position of the movable cutting jaw 23. In the end region facing away from the pivot joint 20 the pushing lever 19 comprises a toothing 31 which engages with the toothing 32 of the movable cutting jaw 23 (FIG. 2). The first maximal opening position of the hand levers 2, 3 is (despite of the bias of the movable hand lever 3 by the opening spring 11 in outer direction) defined by the contact of a nose or a protrusion 33 of the hand lever plate 5 with an angular offset or bending (being L-shaped in a first rough approximation) or contacts with a lever part 34 of the latching lever 16. In the first maximal opening position according to FIGS. 2 and 3 the latching nose 30 of the latching lever 16 as well as the toothing 31 of the pushing lever 19 engage the toothing 32 of the cutting jaw 23.

Upon application of actuating forces to the hand levers 2, 3, the hand levers 2, 3 are moved towards each other in a first part of the working stroke. This has the consequence that by the engagement with the toothings 31, 32 the pushing lever 19 applies a closing force upon the movable cutting jaw 23. The closing force comprises a component having an orientation in circumferential direction and in closing direction around the pivot axis of the pivot joint 25. Accordingly, a partial closure of the cutting jaws 23, 26 with a reduction of the cross-sectional surface of the cutting contour 29 will be caused. In this way, a partial cutting of the workpiece which is located in the accommodation 28 is provided. During the closing movement of the movable cutting jaw 23, the latching lever 16 is able to move elastically in outer direction. The latching nose 30 slides (dependent on the extent of the movement of the movable cutting jaw 23) over the toothing 32 with successive engagements into the passed intermediate tooth spaces of the toothing 32. If instead the closing actuating forces are reduced and removed and instead the hand levers 2, 3 are again opened for a further part of the working stroke of the manual pliers 1 with the engagement of the latching nose 30 of the latching lever 16 into the last reached intermediate space between the adjacent tooth of the toothing 32, a previously reached closing position of the cutting jaws 23, 26 is secured. During this opening movement, the pushing lever 19 is able to move elastically and the toothing 32 of the pushing lever 19 is able to slide over the toothing 32 of the movable cutting jaw 23. In this way, during the opening movement the point of engagement of the toothing 32 of the pushing lever 19 with the toothing 32 of the cutting jaw 23 changes. Then, for the next part of the working stroke, the hand levers 2, 3 are again closed. With this closing movement (corresponding to the explanation of the previous part of the working stroke) the pushing lever 19 is able to cause a further closure of the cutting jaws 23, 26 with a sliding movement of the latching nose 30 of the latching lever 16 over the toothing 32. A plurality of working strokes of this type will then be successively provided until the cutting contour has been completely closed so that the workpiece is completely cut.

Figure 5:
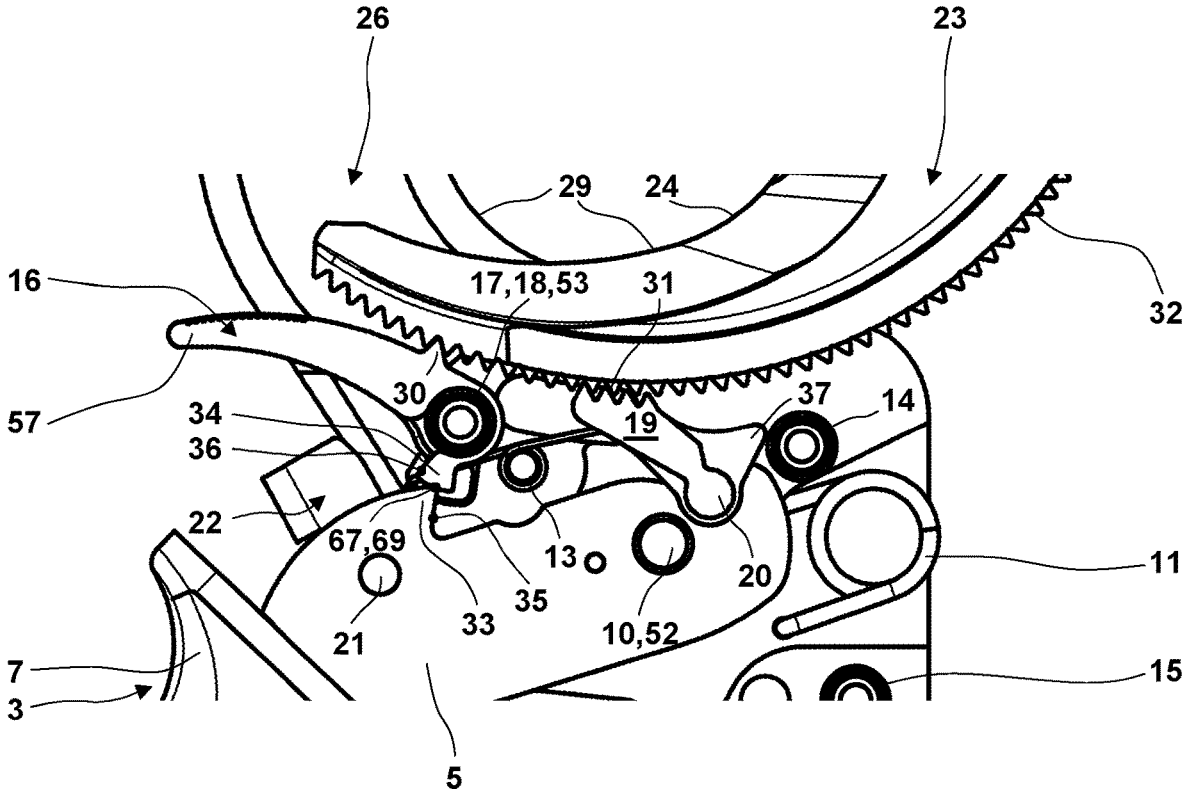

If despite of the application of high actuating forces upon the hand levers 2, 3 it is not possible to completely cut the workpiece, it may be required to interrupt the actuation process before running completely through the working stroke. Due to the extensive compression of the workpiece, the interruption of the actuation in the beginning leads to an elastic opening movement of the cutting jaws 23, 26. During this elastic opening movement the toothing 31 of the pushing lever 19 will be able to slide along the toothing 32. However, an opening movement of this type is not allowed by the latching lever 16 (or dependent on the position of the latching nose 30 relative to the toothing 32 only permitted to a limited extent). The latching nose 30 of the latching lever 16 engages in a blocking fashion into the toothing 32 of the cutting jaw 23 so that a continuation of the elastic opening movement of the cutting jaws 23, 26 is not allowed. Due to the in some circumstances large pressing force between the latching nose and the toothing 32 caused by the elastic expansion of the workpiece, it is possible that a simple manual actuation of the latching lever 16 in opening direction for allowing a further opening of the cutting jaws 23, 26 and for allowing a removal of the partially cut workpiece is not possible. This situation is shown in FIG. 5 with the release of the toothing 31 of the pushing lever 19 from the toothing 32 of the movable cutting jaw 23 but the engagement of the latching nose 30 of the latching lever 16 with the toothing 32 of the cutting jaw 23.

Figure 6:
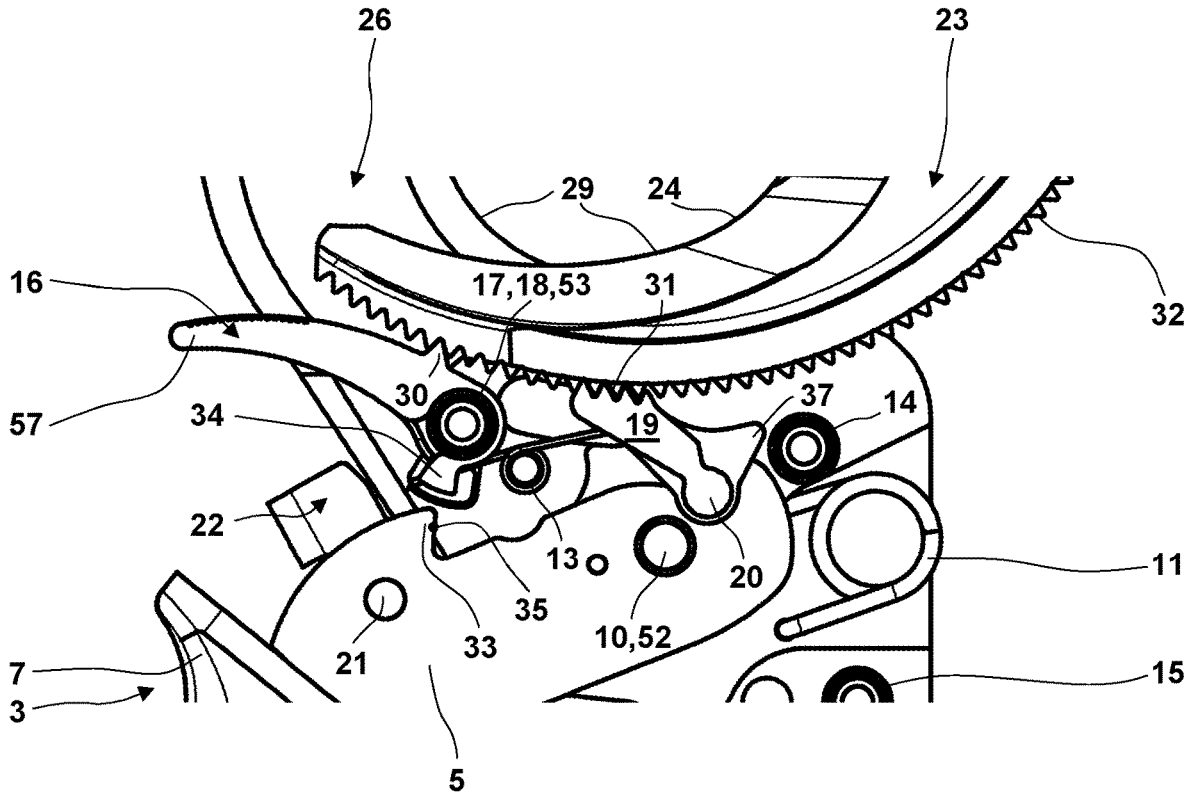
Figure 7:
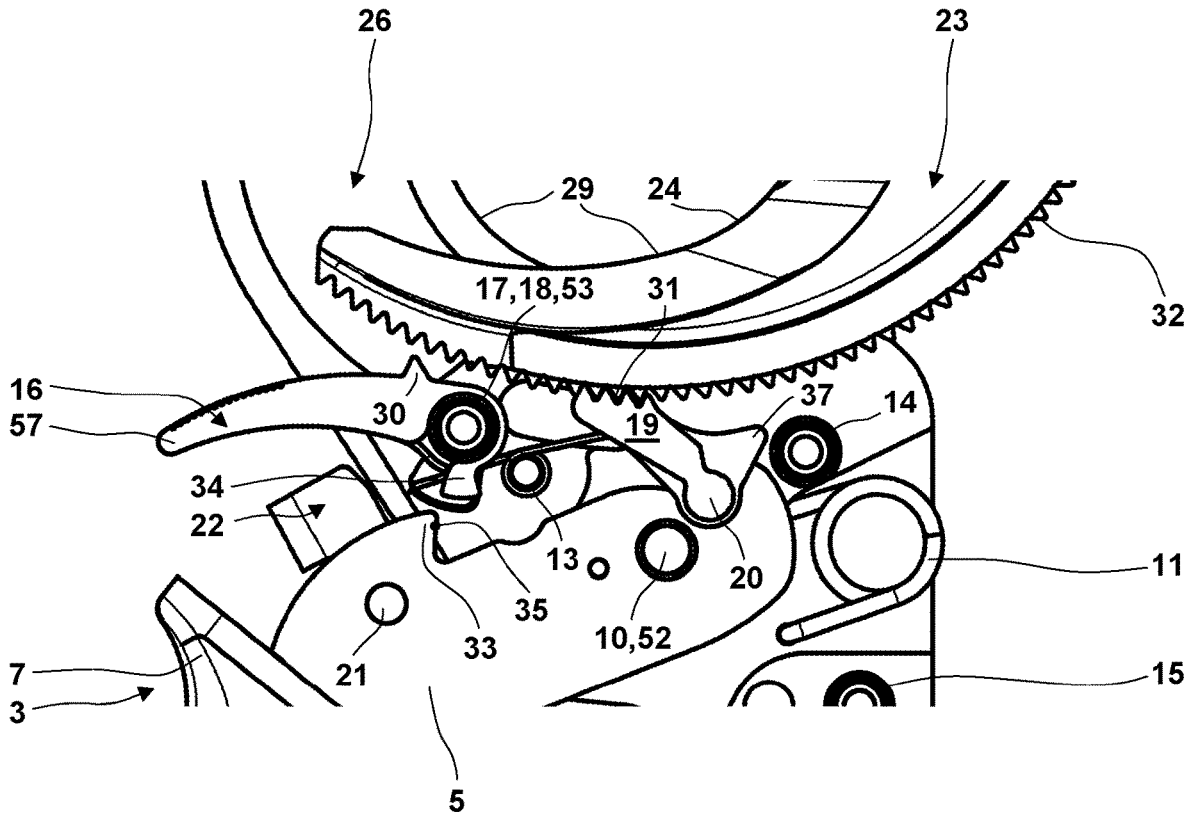

In order to allow the release of the latching lever 16 and the further opening of the cutting jaws 23, 26, according to FIG. 6 the hand levers 2, 3 will be slightly closed with the result of another elastic compression of the workpiece. This closure has the consequence that the pushing lever 19 again engages with its toothing 31 with the toothing 32 of the cutting jaw 23. With an increase of the actuating force transferred by the pushing lever 19 to the cutting jaw 23, the contact between the latching nose 30 of the latching lever 16 and the toothing 32 of the cutting jaw 23 will be relieved so that it is also possible to manually release the latching lever 16 by a pivoting movement of the same away from the toothing 32 (FIG. 7). Accordingly, for actuated latching lever 16 it is possible to open the cutting jaws 23, 26 so that it is possible to remove the workpiece.

For the opening of the hand levers 2, 3 the maximal opening position is not defined by the contact of the protrusion 33 of the hand lever plate 5 with the lever part 34 of the latching lever 16. Instead, for actuated latching lever 16 the protrusion 33 is able to pass the lever part 34 with the opening movement of the hand lever 3. Accordingly, a second maximal opening angle is allowed which is larger than the first maximal opening angle of FIG. 3. In the second maximal opening position the protrusion 33 of the hand lever plate 5 engages behind the lever part 34. Via the protrusion 33 the opening spring 11 biases the hand lever part 34 in opening direction of the latching lever 16 so that in the second maximal opening position also the latching lever 16 is secured in a position in which the latching nose 30 of the latching lever 16 does not engage with the toothing 32 of the cutting jaw 23. In this second maximal opening position it is possible to insert a new workpiece into the accommodation 28. Here, it is also possible that the cutting jaws 23, 26 are manually closed over a stroke part until the cutting jaws 23, 26 get into contact with the outer surface of the new workpiece.

When starting from the second maximal opening position, with a small closure of the hand levers 2, 3 the contact surface 35 of the protrusion 33 slides along the associated contact surface 33 of the lever part 34 in a direction away from the swivel bolt 17. Here, the friction force between the contact surface 35 and the contact surface 36 only depends on the force of the biasing spring 13. Preferably, for the provision of the mentioned sliding movement between the contact surfaces 35, 36 without a simultaneous considerable pivoting movement of the latching lever 16, the contact surface 35 is shaped concentrically to the pivot axis of the pivot joint 52. If at the end of the sliding movement the protrusion 33 and the lever part 34 do not engage each other, the actuating force 16 comes into effect by pivoting the latching lever 16 towards the tooting 32 for the provision of the engagement of the latching nose 30. At the same time, the outer front side 69 of the lever part 34 (again) forms a stop 67 for the protrusion 33 for limiting the opening position of the hand levers 2, 3 to the first maximal opening position.

Figure 8:
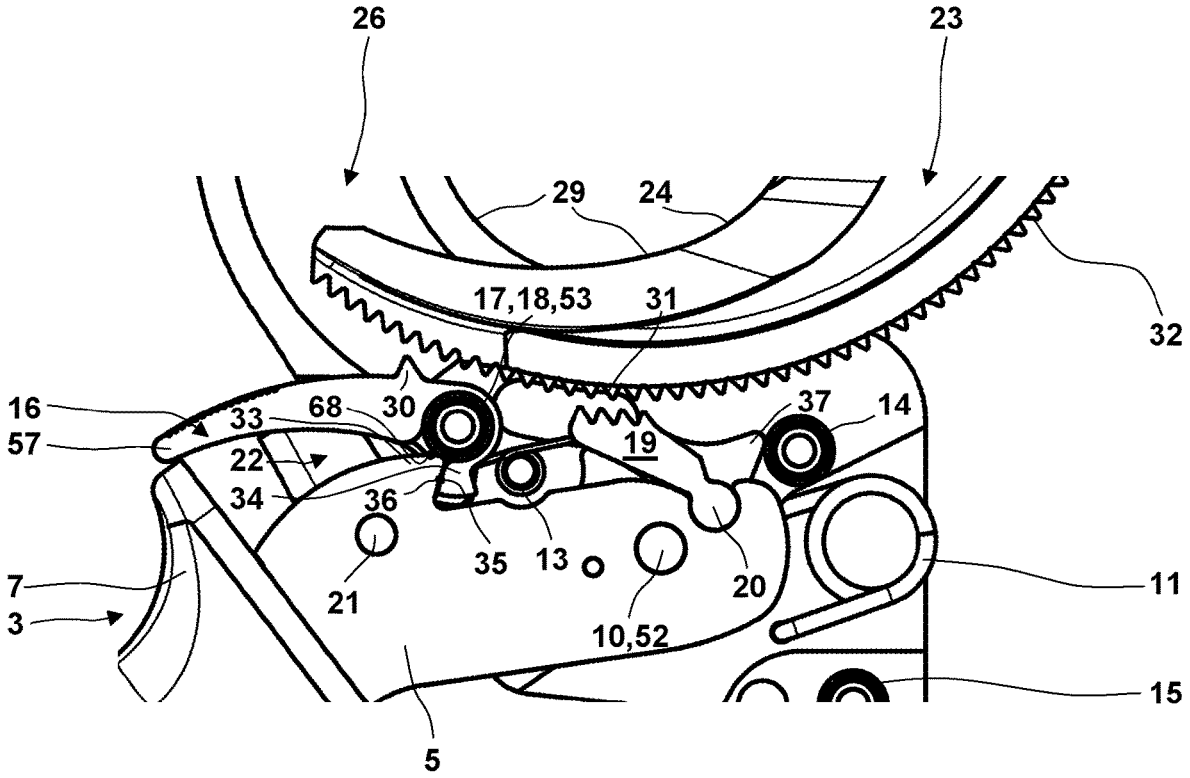

It is possible that with the movement of the hand lever 3 into the second maximal opening position it is not only the latching lever 16 which is pivoted away from the toothing 32. Instead, corresponding to FIG. 8, in the stroke part from the normal maximal opening position to the extended maximal opening position a protrusion 37 of the pushing lever 19 might come into contact with a contact surface which is not moved during the pivoting movement of the hand lever 3. For the shown embodiment, this contact surface is formed by the distance holder 14. With the provision of the contact between the protrusion 37 and the distance holder 14 the further pivoting movement of the hand lever 3 in opening direction (so in FIG. 8 in clockwise direction) leads to the result that (due to the contact of the protrusion 37 with the distance holder 14) the protrusion 37 and so the pushing lever 19 are pivoted in opposite direction (so in counter-clockwise direction) so that the pushing lever 19 is pivoted away from the toothing 32. In the extended opening position according to FIG. 8 (which is automatically maintained due to the bias of the hand levers 2, 3 by the opening spring 11) both the latching lever 16 as well as the pushing lever 19 are in a secured position. In the secured position the latching lever 16 and the pushing lever 19 do not engage the toothing 32 of the cutting jaw 23. Accordingly, it is possible to freely pivot the cutting jaw 23. This free pivoting movement can be used for manually pivoting the cutting jaws towards each other after inserting the workpiece into the maximally opened cutting jaws 23, 26 until the cutting jaws contact the outer surface of the workpiece. Only in this position the hand levers 2, 3 are actuated with the provision of the engagement of the latching lever 16 and/or the pushing lever 19 into the toothing 32 of the cutting jaw 23. This leads to the advantage that at the beginning of the actual working stroke of the manual pliers 1 there is no empty stroke with a closure of the hand levers 2, 3 until the cutting jaws 23, 26 contact the outer surface of the workpiece so that the number of working stroke parts required will be reduced.

If the hand levers 2, 3 have been closed, it is possible to pivot the fixing lever 22 about the pivot joint 21 in inner direction so that the fixing lever 22 engages into a recess of the cutting jaw 23 (here not shown) with a positive form lock for fixing the position of the hand lever 3. This might lead to advantages as a compact storage of the manual pliers with closed hand levers 2, 3 (e.g. in a tool box).

Depending on whether there is a driving coupling of the hand levers 2, 3 to the cutting jaws 23, 26, there is a limitation of the first maximal opening position ([[cp.]] FIG. 3), there is an engagement of the latching nose 30 of the latching lever 16 with the toothing 32 of the cutting jaw and/or the latching lever 16 has not been manually actuated (in the following "operating position")

or there is no driving coupling of the hand levers 2, 3 with the cutting jaws 23, 26, there is a limitation to the second maximal opening position ([[cp.]] FIG. 8), there is no engagement of the latching nose 30 of the latching lever 16, of the toothing 31 of the pushing lever 19 with the toothing 32 of the cutting jaw and/or the latching lever 16 has been actuated manually (in the following "loading and removal position"), different stops 67, 68 and contact surfaces for the hand lever plate 5 may become effective:

In the loading and removal position the opening spring 11 presses the hand lever 3 with the contact surface 34 of the protrusion 33 against the contact surface 36 of the lever part 34. It is also possible that with its front face the protrusion 33 contacts the swivel bolt 17 or distance holder 18 so that the swivel bolt 17 forms a stop 68. In this way, the loading and removal position or the second maximal opening position is defined.

Instead, in the operating position at the beginning of the working process the opening spring 11 presses the protrusion 33 of the hand lever 3 against the outer front surface 69 of the lever part 34 so that there is a limitation to the first maximal opening angle.

For manual pliers according to the prior art (e.g. DE 43 03 180 C1), the closure of the hand levers is provided by a movement of the movable hand lever in clockwise direction leading to an actuation of the movable cutting jaw in the same direction, so here also in the clockwise direction. Instead, for the embodiment shown here, the movement of the movable hand lever 3 in clockwise direction leads to a simultaneous movement of the movable cutting jaw 23 in counter-clockwise direction. This is the case because for the above mentioned prior art the pivot joint for the pushing lever 19 is located between the pivot joint 10 for the linkage of the hand lever 3 and the handle 7. Instead, for the embodiment shown here, the pivot joint 10 for the linkage of the hand lever 3 is located between the pivot joint 20 for the linkage of the pushing lever 19 and the handle 7. This leads to the result that according to the prior art the pushing lever force component which is applied by the pushing lever 19 upon the toothing and which causes a moment about the pivot joint 52 has an orientation opposite to the actuating force component which is applied by the user upon the hand lever 3 and which is effective with respect to the pivot joint 52. Instead, for the embodiment shown here, the pushing lever force component 55 applied by the pushing lever 19 upon the toothing (which causes a moment with respect to the pivot joint 52) has the same direction as the actuating force component 56 which is applied by the user upon the hand lever and which has an effect with respect to the pivot joint 52. For the embodiment known from the prior art the movable hand lever forms only a pivot arm with respect to the pivot joint for the linkage of the movable hand lever to the fixed hand lever which is biased on the same side of the pivot joint both by the actuating force component as well as by the pushing lever force component are applied. Instead, for the shown embodiment the hand lever 3, respectively the hand lever plate 5 form lever parts on both sides of the pivot joint 52 wherein the pushing lever 19 is linked to one lever part so that the pushing lever force component 55 acts upon this lever part, whereas the actuating force component 56 is applied to the other lever part.

The latching lever 16 integrally and directly forms an actuation means 57 which is in particular an end region of the latching lever 16 which protrudes from the pliers head and which is accessible from the outside. Accordingly, here the unlatching of the latching lever 16 is not provided by another component and/or an interposed transmitting connection.

A spring base of the biasing spring 13 biases the pushing lever 19 towards the toothing of the movable cutting jaw 23. The other spring base of the biasing spring 13 biases the latching lever 16 towards the toothing 32 of the movable cutting jaw 23. Accordingly, the biasing spring 13 is used in a multifunctional way.

According to the invention, on the one hand the multifunctional biasing spring 13 is used for biasing both the latching lever 16 as well as the pushing lever 19 and on the other hand a separate opening spring 11 are used for biasing the hand levers 2, 3 in opening direction.

In the open position according to FIG. 3 the opening spring 11 causes a contact force by which the protrusion 33 is pressed towards the swivel bolt 17 to the outer front side 69 of the lever part 34 of the latching lever 16. Accordingly, the front side 69 of the lever part 34 forms a stop 67 for the hand lever 3 or the hand lever plate 5. For the provision of the loading and removal position (so an unlocking of the latching lever 16) the latching lever 16 is pivoted towards the handle 7, so away from the pliers head. Preferably, the pivoting movement for the unlocking of the latching lever 16 is provided by the thumb, whereas the other parts of the hand of the user further contact the hand lever 3 or even both of the hand levers 2, 3. The radial extension of the lever part 34 (so the distance of the radial outer front side 69 of the lever part 34 from the outer surface of the swivel bolt 17) defines the difference between the first maximal opening position and the second maximal opening position.

The movable cutting jaw 23 and the movable hand lever 3, respectively the hand lever plate 5 are preferably pivoted in the same plane which is located between the two housing plates 9, 27. Preferably, also the latching lever 16 and the pushing lever 19 are pivoted in this plane. For all of the possible pivoting angles of the hand lever plate 5 and for a viewing direction perpendicular to the pliers head plane there is no overlap of on the one hand the hand lever plate 5 and the components moved therewith and on the other hand of the movable cutting jaw 23.

In order to reduce the diversity of components, simplify the storage and simplify the manufacturing process, the manual pliers 1 are manufactured from modules or in a modular system. Here, the manual pliers 1 comprise a pliers head module 38, a transmission module 39 and at least one hand lever module 40.

The transmission module 39 comprises transmission elements as the latching lever 16, the pushing lever 19 and at least the part of the hand lever plate 5 forming the pivot joint 20, the distance holders 14, 15, 18 and/or the swivel bolts 10, 17 and/or the bolt 12. These elements can be held in a loss-proof fashion or only loosely linked before the connection of the transmission module 39 with other modules. The transition module 39 here does not have a design being closed on both sides of the pliers head plane. Instead, the transmission module 39 is only on one side limited by the housing plate 9, whereas the afore mentioned components of the transmission module 39 are freely accessible from the other side via an opening 63. Preferably, the distance holders 14, 15, 18, the bolt 12, the swivel bolt 10 and the swivel bolt 17 are only housed, born or held in one of their end regions in the housing plate 9, whereas the afore mentioned other components are supported by these components and the other end region of these components is freely accessible before the assembly of the pliers head module 38.

Figure 9:
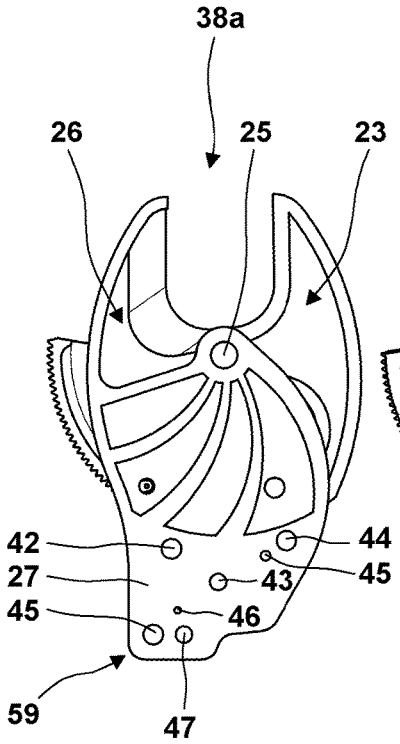
Figure 9:
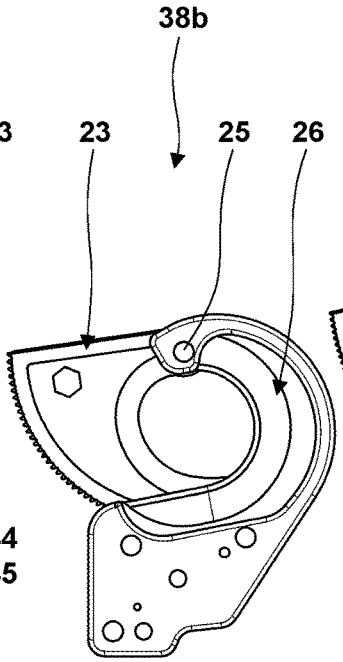
Figure 9:
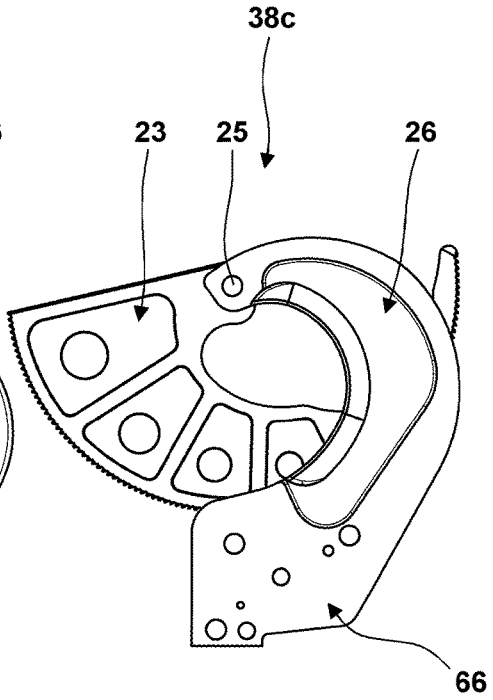
Figure 9:
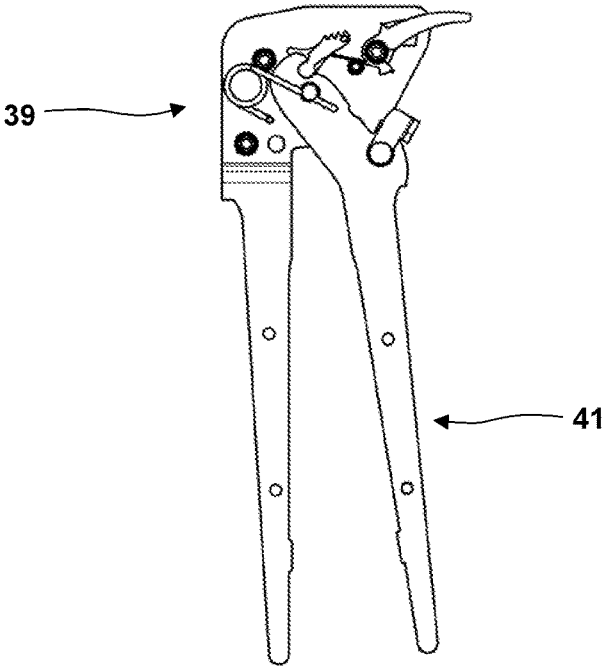

According to FIGS. 9(*a*), 9(*b*), 9(*c*), and 9(*d*), the transmission module 39 integrally forms also the hand lever plate 4. Also the hand lever plate 5 extends integrally into the transmission module 39 so that a base module 41 is formed. The base module 41 on the one hand provides the supporting elements for the handles 6, 7 and on the other hand provides the housing plate 9 and the components of the transmission module 39 held thereat.

According to FIGS. 9(*a*), 9(*b*), 9(*c*), and 9(*d*), for the manufacturer it is possible to optionally combine the same base modules 41 with different pliers head modules 38*a*, 38*b*, 38*c*. For this purpose, there are no adaptations of the components of the transmission module 39 or the base module 41 required (in particular no changes of the shape or contours, no exchange of components and/or no adaptation of bore diameters or an adaptation of the pattern of drilling).

The pliers head module 38*a* is a so-called front-cutting pliers head module wherein the accommodation 28 formed by the cutting jaws 23, 26 is not closed in circumferential direction. Instead, here the accommodation 28 is open (e.g. U-shaped or V-shaped). In contrast, the pliers head modules 38*b*, 38*c* are looping, entangling or closed pliers head modules, wherein the cutting jaws 23, 26 delimit or define an accommodation 28 which is closed in circumferential direction at the beginning of the working stroke as well as during the whole working stroke. Here, the pliers head modules 38*b*, 38*c* differ in their size of the cutting jaws 23, 26, the formed accommodation 28, the cutting contour 29 and with respect to the workpieces and geometries of the workpieces that can be processed with these pliers head modules 38*b*, 38*c*.

According to FIGS. 9(*a*), 9(*b*), 9(*c*), and 9(*d*), the pliers head modules 38*a*, 38*b*, 38*c* each comprise a housing plate 27 having the same bores at the same positions with the same relative pattern and the same diameters. As an example, these bores will be explained for the pliers head module 38*a*, wherein the same applies for the pliers head modules 38*b*, 38*c*.

A bore 42 serves for housing the distance holder 14. A bore 43 serves for housing the swivel bolt 10. A bore 44 serves for housing the swivel bolt 17 or distance holder 18, whereas an adjacent bore 45 serves for housing the bolt 12. Another bore 45 located in the lower end region of the housing plate serves for accommodating the distance holder 15. Another bore 46 serves for housing an end region of a spring base of the opening spring 11, here a leg of the spiral spring or leg spring.

For the assembly of the respective pliers head module 38*a*, 38*b*, 38*c*, the pliers head module 38*a*, 38*b*, 38*c* is approached to the base module 41 from the open side of the transmission module 39 with an orientation parallel to the housing plate 9 of the transmission module 39. In the end the end regions of the swivel bolt 17, the distance holder 18, bolt 12, swivel bolt 10, distance holder 14, the opening spring 11 and the distance holder 15 enter into the associated bores 42 to 46. A fixation can be provided by a crimping or additional securing measures (e.g. screwing, widening and the like). The end position of the housing plates 9, 27 with a defined distance of the housing plates 9, 27 from each other is defined by the distance holders 14, 15, 18. In any case, with the assembly of the housing plate 27 the components are caught or trapped in a loss-proof fashion between the housing plates 9, 27. Moved components are guided between the housing plates 9, 27, and the end regions of the swivel bolt 17, distance holders 18, bolts 12, swivel bolts 10, distance holders 14 and distance holders 15 are each held in a housing plate 9, 27.

Preferably, the housing plate 27 of the pliers head module 38 is equipped with an additional bore 47 which does not fulfill any function for the embodiment according to FIGS. 9(*a*)-9(*d*).

Figure 10:
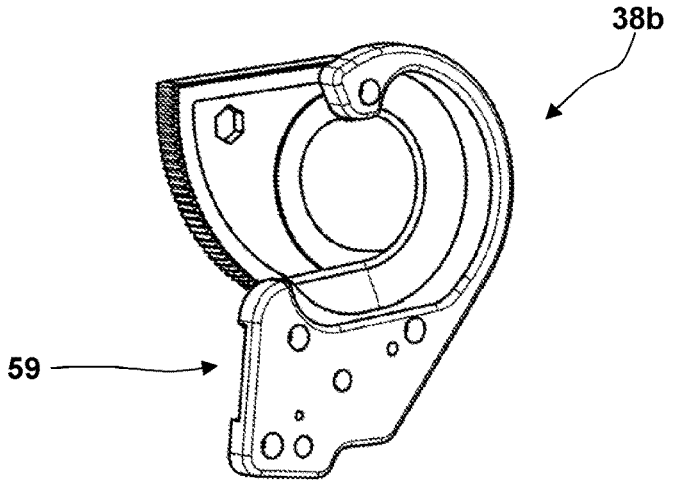
Figure 10:
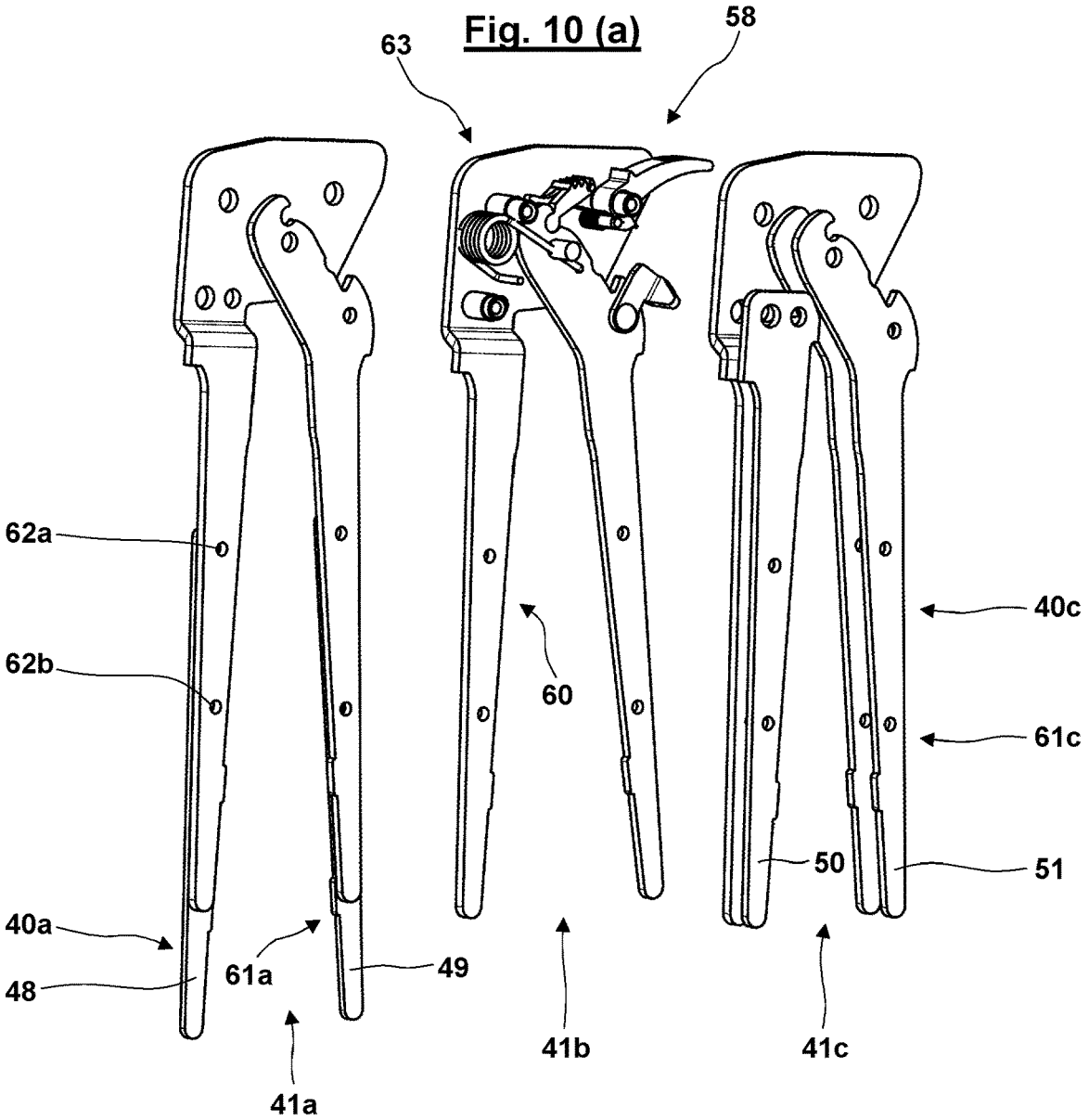

According to FIGS. 10(*a*), 10(*b*), 10(*c*), and 10(*d*), it is possible to combine a pliers head module 38*b* (and in the same way also another pliers head module 38*a*, 38*c*) with different base modules 41, 41*b*, 41*c*. These base modules 41*a*, 41*b*, 41*c* preferably comprise identical transmission modules 39 and in particular identical housing plates 9 with identical bore patterns and bore diameters as well as identical transmission elements as latching lever 16 and pushing lever 19. In order to simplify the drawings, the distance holders, latching levers, pushing levers, swivel bolts and the different springs as well as the fixing lever are only shown for the base module 41*b* despite of the fact that these are also present at the base modules 41*a*, 41*c*.

Differing from the base module 41*b* the base module 41*a* comprises hand lever extensions 48, 49 which are plate-like extensions, which partially overlap the hand layer plates 4, 5 and which are connected to the hand lever plates 4, 5 (in particular by riveting, screwing, adhering and the like). Instead, for the base module 41*c* reinforcements 50, 51 are provided in the region of the hand levers 2, 3. In the region of the hand levers 2, 3 the reinforcements 50, 51 extend parallel to the hand lever plates 4, 5. The reinforcements 50, 51 are held with a defined distance by the hand lever plates 4, 5. For this purpose, in the end region facing towards the transmission module 39 the reinforcement 50 is supported via the distance holder 15 at the housing plate 9. Additionally, another distance holder is used (here not shown) which is housed in the bore 47 of the housing plate 27 and a corresponding bore of the reinforcement 50. An additional mounting (in particular screwing, riveting or adhering connection) can be provided in the region of the handles 2, 3 (in particular under use of additional distance holders). The corresponding applies for the connection between the reinforcement 51 to the hand lever plate 5. Also here a connection between the reinforcement 51 and the hand lever plate 5 might be provided by the swivel bolt 10 and a swivel bolt used for building the pivot joint 21.

Figure 11:
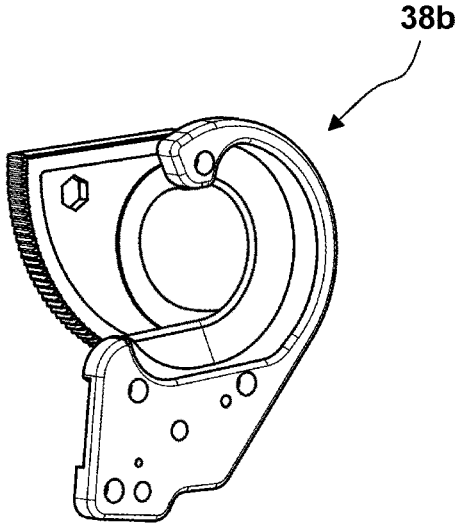
Figure 11:
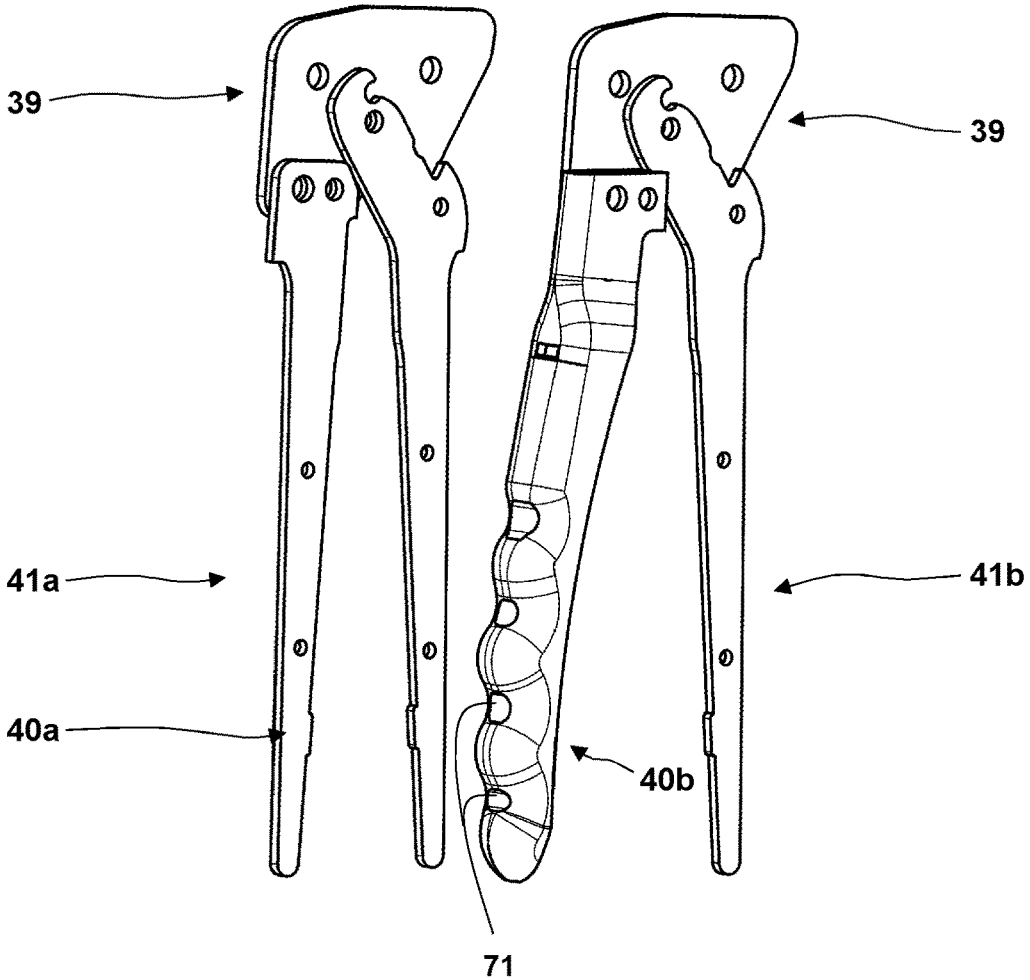

For the embodiments described above, the housing plate 9 and the hand lever plate 4 have an integral design. Instead, FIGS. 11(*a*), 11(*b*), and 11(*c*) embodiments wherein the housing plate 9 and the hand lever plate 4 are formed separately from each other. The housing plate 9 is a component of the transmission module 39, whereas the hand lever plate 4 is a component of the hand lever module 40. Here, FIGS. 11(*a*)-11(*c*) show different hand lever modules 40*a*, 40*b* which can optionally be connected to a transmission module 39. Also here the connection is provided both by the distance holder 15 as well as by an additional distance holder which extends through the bore 47. A base module 41 of this type formed with the hand lever module 40*a*, 40*b* and the transmission module 39 can optionally be assembled to a pliers head module 38*b* (or also 38*a*, 38*c*). The hand lever module 40*b* comprises a configuration which provides handle recesses 71 for the fingers of the hand of the user of the manual pliers 1.

In the state disassembled from the pliers head module 38 the transmission module 39 comprises an interface 58 by which it is possible to mount the transmission module 39 to a corresponding counter-interface 59 of a pliers head module 38. Here the interface 58 is formed by the housing plate 27. The interface 58 of the transmission module 39 is preferably formed by the free end regions of the distance holders 14, 15, 18, the swivel bolt 10 and the bolt 12. Instead, the counter-interface 59 is formed with the bores 42 to 47. In a corresponding way the transmission modules 39 comprise interfaces 60 which can be coupled to identical counter-interfaces 61 of different hand lever modules 40*a*, 40*b*, 40*c*. Here, the interfaces 60 are formed by bores and/or the distance holder 15 and further bores 62 to which the hand lever modules 40*a*, 40*b*, 40*c* can be assembled.

Preferably, the housing plate 27 of the pliers head module 38 integrally forms the fixed cutting jaw 26. Preferably, the pliers head module 38 consists only of a base body 66 formed with the housing plate 27 and the fixed cutting jaw 26 (wherein the base body 66 preferably has a planar design), the movable cutting jaw 23 and the components required for the formation of the pivot joint 25. Preferably, the base body 36 which forms the cutting jaw 26 and the housing plate 27 is a precision casting part. Other components (in particular the hand lever plates 4, 5 with the housing plate 9) can be manufactured by punching.

For the embodiments of FIGS. 10(*a*)-10(*d*) generally the same manual pliers 1 can on the one hand be formed only with one single hand lever plate for each hand lever and on the other hand with doubled hand lever plates for each hand lever, wherein the last mentioned embodiment provides manual pliers 1 with increased stiffness and solidity.

In the plan view of FIG. 2 and in a view vertical to the pliers head plane the pivot joint 52 and the longitudinal axis 64 running therethrough divides the manual pliers 1 into a right half longitudinal plane 70 and a left half longitudinal plane 65. The handle 7 of the movable hand lever 3 and the latching lever 16 including its bearing in the region of the pivot joint 53 are here arranged in the same half longitudinal plane 65. If the hand lever 3 is pivoted in clockwise direction for the opening of the hand levers 2, 3 in FIG. 3, this movement correlates with a pivoting movement of the latching lever 16 for the unlatching of the same from the toothing 32 in clockwise direction. The actuation means 57 of the latching lever 16 and the handle 7 of the movable hand lever 3 are located on the same side of the manual pliers 1.

Manual pliers 1 of the present type are also denoted as "ratchet cutters".

In the pushing direction of the pushing lever 19 the latching nose 30 of the latching lever 16 engages into the toothing 32 of the movable cutting jaw in a position in front of the pushing lever 19.

The latching lever 16 also comprises an elongate lever part additional to the lever part 34. The end region facing away from the pivot joint 53 of the elongate lever part forms the actuation means 57. The latching nose 30 is formed at this lever part in a position between the pivot joint 53 and the actuation means 57. This lever part forms approximately a right angle to the lever part 34.

For the shown embodiment the latching lever 16 comprises only one latching nose 30. For a modified embodiment the latching lever 16 comprises a latching toothing which engages the toothing 32 of the movable cutting jaw 23.

A transmission is interposed between the hand levers 2, 3 and the cutting jaws 23, 26. The transmission comprises the pushing lever 19 and the latching lever 16 which form transmission elements being located parallel to each other in the force flow. The transmission is laterally open. In the assembled state the transmission is limited transverse to the pliers head plane in a respective direction by a housing plate 9, 27. Instead, without assembled pliers head module 38 the transmission module 39 is limited in a direction transverse to the pliers head plane only in one single direction by the housing plate 9.

Many variations and modifications may be made to the preferred embodiments of the invention without departing substantially from the spirit and principles of the invention. All such modifications and variations are intended to be included herein within the scope of the present invention, as defined by the following claims.

We claim:

1. A group of manual cutters, comprising:

a) manual cutters of a first group part, and b) manual cutters of a second group part, c) wherein the manual cutters of the first group part and the manual cutters of the second group part have different configurations to process different workpieces, wherein d) the manual cutters of the first group part and the manual cutters of the second group part have a modular design and comprise differing cutters head modules, identical transmission modules, and a respective movable hand lever, e) each cutters head module of the differing cutters head modules comprises a base body having a respective first housing plate and respective cutting jaws, the respective cutting jaws comprising a respective fixed cutting jaw and a respective movable cutting jaw having respective first toothing, the respective cutting jaws of a first cutters head module of the differing cutters head modules comprise open cutting jaws in a first configuration of the differing configurations, and the respective cutting jaws of a second cutters head module of the differing cutters head modules comprise circumferential closed cutting jaws in a second configuration of the differing configurations, f) each transmission module of the identical transmission modules comprises a respective second housing plate and respective transmission elements, the respective transmission elements comprising a respective latching lever and a respective pushing lever, and the respective second housing plate comprising at least one respective swivel bolt, g) each transmission module of the identical transmission modules is mounted to the respective movable hand lever, the respective movable hand lever is pivotably coupled to the at least one respective swivel bolt thereby forming a respective first pivot joint, h) the respective pushing lever comprises a respective second toothing at a respective first end of the respective pushing lever, the respective second toothing being directly engaged with the respective first toothing of the respective movable cutting jaw of the respective cutting jaws of a respective differing cutters head module of the differing cutters head modules, a respective second end of the respective pushing lever is pivotably coupled to a respective distal end of the respective movable hand lever thereby forming a respective second pivot joint, the respective first pivot joint being located between the respective second pivot joint and a respective proximal end of the respective movable hand lever, and movement of the respective movable hand lever about the respective first pivot joint results in movement of the respective pushing lever about the respective second pivot joint and causes rotation of the respective movable cutting jaw of the respective cutting jaws of the respective cutters head module in an opposite direction;

i) the respective latching lever comprises a respective latching nose being latched to the respective first toothing of the respective movable cutting jaw of the respective cutting jaws for latching a respective pivot position of the respective movable cutting jaw of the respective cutting jaws, the respective latching lever being coupled to the respective second housing plate at a respective third pivot joint, j) movement of the respective pushing lever about the respective second pivot joint provides for the engagement of the respective second toothing of the respective pushing lever with the respective first toothing of the respective movable cutting jaw thereby driving movement of the respective latching lever about the respective third pivot joint, k) the respective cutters head module of the differing cutters head modules is assembled to a respective transmission module of the identical transmission modules such that a first end region of the at least one respective swivel bolt is mounted to the respective first housing plate of an integral base body of the respective cutters head module and a second end region of the at least one respective swivel bolt is mounted to the respective second housing plate of the respective transmission module, l) each transmission module forms an opening through which the at least one respective swivel bolt and the respective transmission elements of the identical transmission modules are exposed when the respective cutters head module is detached, m) the opening is at least partially closed by the respective first housing plate of the respective cutters head module, and n) in this at least partially closed state of the opening, the respective transmission elements of the respective transmission module are moved and extend between the respective second housing plate of the respective transmission module and the respective first housing plate of the respective cutters head module, in the at least partially closed state the respective second housing plate of the respective transmission module and the respective first housing plate of the respective cutters head module being fixedly mounted to each other.

2. The group of manual cutters of claim 1, the respective first toothing being disposed along an edge of the respective movable cutting jaw.

3. The group of manual cutters of claim 2, wherein pivoting the respective movable hand lever causes rotation of the respective movable cutting jaw of the respective cutting jaws, and the respective movable hand lever and the respective movable cutting jaw of the respective cutting jaws pivot on different axes.

4. The group of manual Oars cutters of claim 3, wherein movement of the respective movable hand lever in a clockwise direction leads to a simultaneous movement of the respective movable cutting jaw of the respective cutting jaws.

5. The group of manual cutters of claim 2, wherein the respective transmission elements of the respective transmission module are supported by the respective second housing plate to guide the respective transmission elements during actuation of the manual cutters of the first group part or the manual pliers of the second group part.

6. The group of manual cutters of claim 2, wherein:

each cutters head module of the differing cutters head modules comprises a respective fourth pivot joint linking the respective movable cutting jaw to the respective fixed cutting jaw of the respective cutting jaws.

* * * * *